US010497310B2

(12) United States Patent
Lu et al.

(10) Patent No.: US 10,497,310 B2
(45) Date of Patent: Dec. 3, 2019

(54) TFT COMPENSATION CIRCUIT FOR DISPLAY DEVICE USING REFERENCE CURRENT

(71) Applicant: Sharp Kabushiki Kaisha, Osaka (JP)

(72) Inventors: Tong Lu, Oxford (GB); Christopher James Brown, Oxford (GB); Michael James Brownlow, Oxford (GB); Tim Michael Smeeton, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/933,474

(22) Filed: Mar. 23, 2018

(65) Prior Publication Data

US 2019/0295467 A1 Sep. 26, 2019

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/043* (2013.01); *G09G 2300/0819* (2013.01)

(58) Field of Classification Search
CPC ..... G09G 3/3233; G09G 3/3291; G09G 2300/043
See application file for complete search history.

(56) References Cited

U.S. PATENT DOCUMENTS 7,414,599 B2 8/2008 Chung et al.
7,812,796 B2 10/2010 Jung
8,284,132 B2 10/2012 Chung
8,405,582 B2 3/2013 Kim
8,643,575 B2 2/2014 Kim
2009/0135107 A1* 5/2009 Kim ..... G09G 3/3233 345/76

(Continued)

*Primary Examiner* — Chun-Nan Lin
(74) *Attorney, Agent, or Firm* — Renner, Otto, Boisselle & Sklar, LLP

(57) ABSTRACT

A pixel circuit for a display device includes a drive transistor configured to control an amount of current to a light-emitting device during an emission phase depending upon a voltage applied to a gate of the drive transistor; a second transistor connected to the gate of the drive transistor, wherein the second transistor is in an on state during a combined programming and compensation phase and in an off state during the emission phase, and when the second transistor is in an on state the drive transistor becomes diode-connected such that a gate and a second terminal of the drive transistor are connected through the second transistor; a third transistor connected to the second terminal of the drive transistor, wherein the third transistor is in an on state during the combined programming and compensation phase to permit a reference current to be applied through the drive transistor, and is in an off state during the emission phase to remove the reference current; and a capacitor having a first plate that is connected to the gate of the drive transistor and a second plate that is connectable to a data voltage during the combined programming and compensation phase. A threshold voltage and/or a carrier mobility of the drive transistor is compensated by application of the reference current during the combined programming and compensation phase.

11 Claims, 8 Drawing Sheets

(56) References Cited

U.S. PATENT DOCUMENTS

2009/0309818 A1* 12/2009 Kim ..... G09G 3/3233
345/77
2010/0013868 A1* 1/2010 Chung ..... G09G 3/3233
345/690

* cited by examiner

TFT COMPENSATION CIRCUIT FOR DISPLAY DEVICE USING REFERENCE CURRENT

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Several approaches are taught in the prior art for pixel thin film transistor (TFT) circuits to deliver current to an element of a display device, such as for example an organic light-emitting diode (OLED), through a drive transistor. Conventionally, such circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive TFT. A disadvantage of this approach is that the circuit configuration does not have high tolerance to variation in carrier mobility between different drive transistors.

Another approach is to use a known electrical current, and particularly an externally supplied "reference current", through a drive TFT device as an element of the compensation process. For example, U.S. Pat. No. 8,284,132 (Chung, issued Oct. 9, 2012) describes applying a reference current through the drive device for compensating carrier mobility and voltage threshold variations. The circuit configuration requires two compensation phases which are time consuming, and two capacitors which need relatively large area. Such configuration, therefore, is not suitable for displays with a large number of pixels in which the compensation and programming time needs to be short.

Other approaches for compensation also have proven deficient. U.S. Pat. No. 8,643,575 (Kim, issued Feb. 4, 2014) describes applying a reference current through the drive device for compensating carrier mobility and threshold voltage variations at one capacitor, and then the data voltage is applied at another capacitor. The compensated voltage will redistribute between the two capacitors, and thus the compensation can only be partial. U.S. Pat. No. 7,812,796 (Jung, issued Oct. 12, 2010) describes applying reference current through the drive device for compensating carrier mobility and threshold voltage variations with a reference voltage at one capacitor, and then the data voltage is applied at the same capacitor. A second capacitor is used to store the compensation voltage and data voltage. This configuration requires two compensation phases which are time consuming, and two capacitors which need a relatively large area. Such configuration, therefore, is not suitable for display devices with high resolution. U.S. Pat. No. 8,405,582 (Kim, issued Mar. 26, 2013) describes applying a reference current through the drive device for compensating carrier mobility and threshold voltage variations. The voltage is measured and stored in external units. The external measurements are normally slow, which may not suitable for real time voltage threshold compensation.

SUMMARY OF INVENTION

The present invention relates to pixel circuits that are capable of compensating the threshold voltage variations and carrier mobility variations of the drive transistors, such as may occur, for example, due to the manufacturing process or stress and aging of the circuits in operation. A constant "reference current" is applied to and flows through the drive transistor during a simultaneous compensation and programming phase. This flow of the reference current causes the sum of (1) a voltage related to the threshold voltage of the drive transistor, and (2) a voltage related to the carrier mobility of the drive transistor, to be stored at one terminal of a storage capacitor. During the same time, a data voltage, which represents the programmed greyscale information for the pixel, is applied to the other terminal of the storage capacitor. Hence, the voltage related to the threshold voltage, the voltage related to the carrier mobility, and the data voltage are stored on the same storage capacitor and at the same time during the simultaneous programming and compensation phase.

During a subsequent emission phase, a constant voltage is applied at one terminal of the capacitor. The other terminal of the capacitor stores the voltage information of the threshold voltage, carrier mobility, and greyscale data. This voltage is applied at the gate of the drive TFT transistor. The output current, i.e. the current passing through the drive transistor, to the light-emitting device (OLED) is controlled by this voltage.

Compared to conventional circuit configurations, the circuit configuration of the present disclosure has advantages. In the circuit of the present disclosure, compensation and programming occur simultaneously in a single phase. This is advantageous for completing the compensation and programming steps in a shorter time, which is referred to in the art as the "horizontal time" or "1H". A short 1H time is a requirement for displays with a large number of pixels in a column, as is necessary for high-resolution displays (high pixels per inch or ppi). In addition, the disclosed circuit configuration uses only one capacitor in the pixel circuit, compared with conventional circuits that need at least two capacitors. This means that the total area of the disclosed circuit may be smaller as compared to conventional configurations. This likewise is advantageous for displays with high resolution (high ppi), in which the individual pixels must be as small as practicable.

An aspect of the invention is a pixel circuit for a display device that is operable in a combined programming and compensation phase, and operable in an emission phase. In exemplary embodiments, the pixel circuit includes: a drive transistor configured to control an amount of current to the light-emitting device during the emission phase depending upon a voltage applied to a gate of the drive transistor; a second transistor connected to the gate of the drive transistor, wherein the second transistor is in an on state during the combined programming and compensation phase and in an off state during the emission phase, and when the second transistor is in the on state the drive transistor becomes diode-connected such that a gate and a second terminal of the drive transistor are connected through the second transistor; a third transistor connected to the second terminal of the drive transistor, wherein the third transistor is in an on state during the combined programming and compensation phase to permit a reference current to be applied through the drive transistor, and is in an off state during the emission phase to remove the reference current; and a capacitor having a first plate that is connected to the gate of the drive transistor and a second plate that is connectable to a data voltage VDAT during the combined programming and compensation phase. A threshold voltage and/or a carrier mobility of the drive transistor are at least partially compensated by application of the reference current during the combined programming and compensation phase.

The pixel circuit further may include a fourth transistor that is connected to the second plate of the capacitor, wherein the fourth transistor is in an on state during the combined programming and compensation phase to apply VDAT to the second plate of the capacitor, and the fourth transistor is in the off state during the emission phase to isolate VDAT from the second plate of the capacitor; a fifth transistor that is connectable to a voltage supply and is connected to the second plate of the capacitor, wherein the fifth transistor is in an off state during the combined programming and compensation phase to isolate the second plate of the capacitor from the voltage supply, and the fifth transistor is in the on state during the emission phase to connect the voltage supply to the second plate of the capacitor; and a sixth transistor that is in an off state during the combined programming and compensation phase to isolate the light-emitting device from the pixel circuit, and is in an on state during the emission phase to permit current that flows through the drive transistor to flow to the light-emitting device.

Another aspect of the invention is a method of operating a pixel circuit for a display device that is operable in a combined programming and compensation phase, and operable in an emission phase. In exemplary embodiments, the operating method includes the steps of: providing a pixel circuit according to any of the embodiments; performing the combined programming and compensation phase; and performing the emission phase. The combined programming and compensation phase includes at least partially compensating a threshold voltage and/or a carrier mobility of the drive transistor by application of a reference current by the steps of: placing the second transistor in an on state, wherein the drive transistor becomes diode-connected such that the gate and the second terminal of the drive transistor are connected through the second transistor; placing the third transistor in an on state to permit the reference current to be applied through the drive transistor; and applying a data voltage VDAT to the second plate of the capacitor. The emission phase includes the steps of: placing the second transistor in an off state; placing the third transistor in an off state to remove the reference current; isolating the second plate of the capacitor from VDAT and connecting the voltage supply to the second plate of the capacitor; and controlling an amount of current to the light-emitting device depending upon a voltage applied to a gate of a drive transistor.

In exemplary embodiments, the combined programming and compensation phase further may include: placing the fourth transistor in an on state to apply VDAT to the second plate of the capacitor; placing the fifth transistor in an off state to isolate the second plate of the capacitor from the voltage supply; and placing the sixth transistor in an off state to isolate the light-emitting device from the pixel circuit. The emission phase further may include: placing the fourth transistor in an off state to isolate VDAT from the second plate of the capacitor; placing the fifth capacitor in an on state to connect the voltage supply to the second plate of the capacitor; and placing the sixth transistor an on state to permit current that flows through the drive transistor to flow to the light-emitting device.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
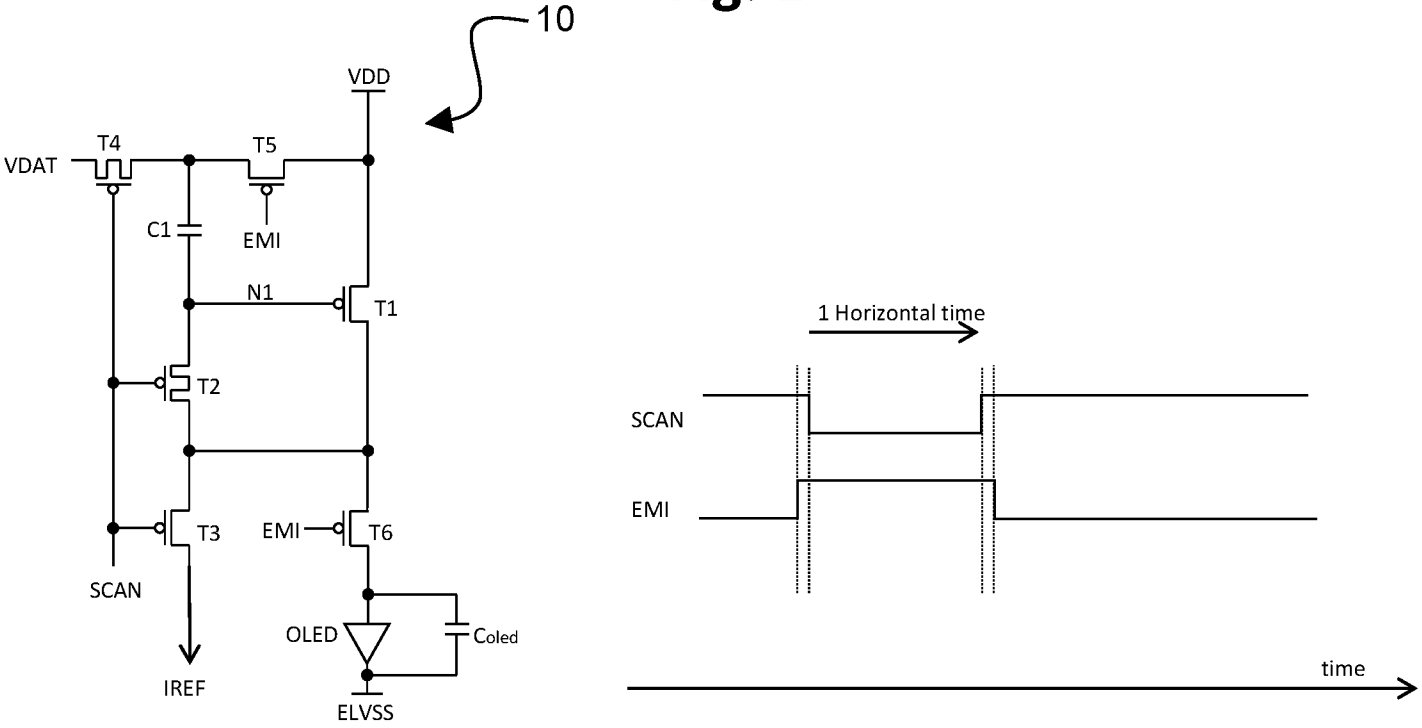
FIG. 1 is a drawing depicting a first circuit configuration in accordance with embodiments of the present invention, and an associated timing diagram.

Embodiments of the present invention will now be described with reference to the drawings, wherein like reference numerals are used to refer to like elements throughout. It will be understood that the figures are not necessarily to scale.

FIG. 1 is a drawing depicting a first circuit configuration 10 in accordance with embodiments of the present invention, and an associated timing diagram. In this example, the circuit 10 is configured as a TFT circuit that includes multiple p-type transistors (T1-T6) and a single capacitor C1. The circuit elements drive a light-emitting device, such as for example an OLED. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 1 depicts the TFT circuit 10 configured with p-MOS or p-type TFTs. T1 is a drive transistor that is an analogue TFT, and T2-T6 are digital switch TFTs. In this exemplary embodiment, T2 and T4 are double-gate TFTs as a preferred embodiment, which have low leakage between source and drain, although T2 and T4 alternatively may be single gate TFTs. As referenced above, C1 is a capacitor, and $C_{oled}$ is the internal capacitance of the OLED device (i.e., $C_{oled}$ is not a separate component, but is inherent to the OLED). The OLED further is connected to a power source ELVSS as is conventional.

The OLED and the TFT circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitor may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VDATA) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistor T6 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to power source ELVSS in this example. The injection layers, transport layers and emission layer may be organic materials, the first and second electrodes may be metals, and all of these layers may be deposited by a thermal evaporation technique.

Referring to the TFT circuit 10 in combination with the timing diagram in FIG. 1, the TFT circuit 10 operates first to perform a combined programming and compensation phase. In the combined programming and compensation phase, an emission signal EMI is changed from a low voltage level to a high voltage level, causing transistors T5 and T6 to be turned off. Hence, the OLED device is isolated from the drive transistor T1, and current to the OLED device is cut off so there is no light emission from the OLED device during the remainder of the combined programming and compensation phase. Additionally, the top plate of the capacitor becomes disconnected from the power supply, VDD.

Also during the combined programming and compensation phase, a scan signal SCAN is changed from a high voltage level to a low voltage level, causing digital switch transistors T2, T3, and T4 to be turned on. When transistor T2 is turned on, the drive transistor T1 is "diode-connected" through transistor T2. Diode-connected refers to the drive transistor T1 being operated with its gate and a second terminal (e.g., drain) being connected, such that current flows in one direction. When transistor T3 is turned on, a reference current IREF is sunk through the diode-connected drive transistor T1 from the power supply VDD. The value of the IREF current is fixed by attaching the terminal labelled IREF in the circuit diagram to an electronic circuit or chip typically external to the pixel, which permits passage of the preferred IREF value, which is referred to as the "reference current driver". The reference current driver may be a source driver or a sink driver.

When the current through drive transistor T1 and the voltage at the gate of the drive transistor T1 become constant, the following equations represent the current and voltage relationships for the drive transistor T1:

$$I_{ref} = \frac{\mu_n C_{ox} W/L}{2}(V_{GS} - V_{TH})^2 = \frac{\mu_n C_{ox} W/L}{2}(V_{N1} - V_{DD} - V_{TH})^2$$

$$V_{N1} = \sqrt{\frac{2I_{ref}}{\mu_n C_{ox} W/L}} + V_{DD} + V_{TH}$$

Where $C_{ox}$ is the capacitance of the TFT gate oxide;
W is the width of the TFT channel;
L is the length of the TFT channel (i.e. distance between source and drain);
$\mu_n$ is the carrier mobility of the drive transistor T1;
and $V_{TH}$ is the threshold voltage of the drive transistor T1.

The capacitor C1 has a first or bottom plate that is connected to the gate of the drive transistor T1, and a second or top plate that is connectable to a voltage supply or reference voltage as further detailed below. The voltage, $V_{N1}$, is the voltage at the capacitor bottom (first) plate (i.e., is the voltage at the node N1 in the circuit diagram), and considering the equations above, such voltage thus includes both carrier mobility and threshold voltage information. When transistor T4 is turned on, the data voltage, VDAT, is applied at the top (second) plate of the capacitor. The voltage across the capacitor C1 between the top and bottom plates is:

$$V_{DAT} - V_{N1} = V_{DAT} - \left(\sqrt{\frac{2I_{ref}}{\mu_n C_{ox} W/L}} + V_{DD} + V_{TH}\right)$$

Second, during an emission phase, the SCAN signal is changed from a low voltage level to a high voltage level, causing transistors T2, T3 and T4 to be turned off. When transistor T2 is turned off, the gate and drain of the drive transistor T1 are disconnected from each other. The node at N1 then becomes floating, which becomes a floating connection between the bottom (first) plate of the capacitor C1 and the gate of the drive transistor T1. When transistor T3 is turned off, the reference current is cut off from the pixel TFT circuit 10. When transistor T4 is turned off, the top (second) plate of the capacitor C1 is disconnected from the data voltage, VDAT. Next the EMI signal is changed from a high voltage level to a low voltage level, causing the transistors T5 and T6 to be turned on. When transistor T5 is turned on, the top (second) plate of the capacitor C1 is connected to the voltage supply VDD, and this causes the voltage at the top plate of the capacitor to change by a voltage equal to $V_{DD}-V_{DAT}$. As the bottom plate of the capacitor C1 is floating, the voltage of the bottom plate follows the voltage change of the top plate. Therefore, the voltage at the bottom plate ($V_{N1}$), and hence the gate voltage of the drive transistor T1, becomes:

$$V_{N1} + (V_{DD} - V_{DAT}) = \sqrt{\frac{2I_{ref}}{\mu_n C_{ox} W/L}} + 2 \cdot V_{DD} + V_{TH} - V_{DAT}$$

When transistor T6 is turned on, the OLED device is connected to drive transistor T1 through the switching transistor T6. Current will flow to the OLED device, and the amount of current is:

$$I_{OLED} = \frac{\mu_n C_{ox} W/L}{2}(V_{GS} - V_{TH})^2 = \frac{\mu_n C_{ox} W/L}{2}(V_{N1} - V_{DD} - V_{TH})^2 = \frac{\mu_n C_{ox} W/L}{2}\left(\sqrt{\frac{2I_{ref}}{\mu_n C_{ox} W/L}} + 2 \cdot V_{DD} + V_{TH} - V_{DAT} - V_{DD} - V_{TH}\right)^2 = \frac{\mu_n C_{ox} W/L}{2}\left(\sqrt{\frac{2I_{ref}}{\mu_n C_{ox} W/L}} + V_{DD} - V_{DAT}\right)^2$$

In view of the above equations, the threshold voltage, $V_{TH}$, has been compensated, i.e. the current through the OLED, $I_{OLED}$, does not depend on the threshold voltage of the T1 drive transistor, $V_{TH}$. When the OLED current is equal to the reference current $I_{REF}$, the TFT circuit 10 compensates for carrier mobility variations in T1 exactly. When the OLED current differs from $I_{REF}$, there is a residual error in the carrier mobility compensation.

More specifically, by comparing the equations of the OLED current before and after compensation, it is clear that the T1 carrier mobility, $\mu_n$, is at least partially compensated. Before compensation:

$$I_{OLED} = \frac{\mu_n C_{ox} W/L}{2}(V_{DAT} - V_{DD} - V_{TH})^2$$

After compensation:

$$I_{OLED} = \left(\sqrt{I_{ref}} + \sqrt{\frac{\mu_n C_{ox} W/L}{2}}(V_{DD} - V_{DAT})\right)^2$$

In this manner, the constant reference current term reduces the effect of the carrier mobility variations.

A properly selected reference current will improve the programming speed and the compensation accuracy. For fast programming, a large reference current is preferred. For carrier mobility compensation, the larger the difference between the reference current and the operational current, the larger the error of the carrier mobility compensation. The operational current is the current through the OLED during the subsequent emission phase. Accordingly, a reference current that is close to the operational current range is preferred for carrier mobility compensation. Depending upon the specific application, the reference current selection process can be selected for operation within the acceptable compensation accuracy and power consumption requirements for such given application, for which a large reference current is preferably selected. To focus more on meeting programming time requirements (i.e., shortening the 1H time) for such given application, a reference current that is closest to the operational current range is preferably selected. These considerations may be balanced or combined so as to select an optimum reference current for any particular application. In one example for an OLED display for mobile device applications, the operational current is from 0 to 50 nA. A reference current of 400 nA is used with consideration of programming speed and compensation accuracy.

Figure 2:
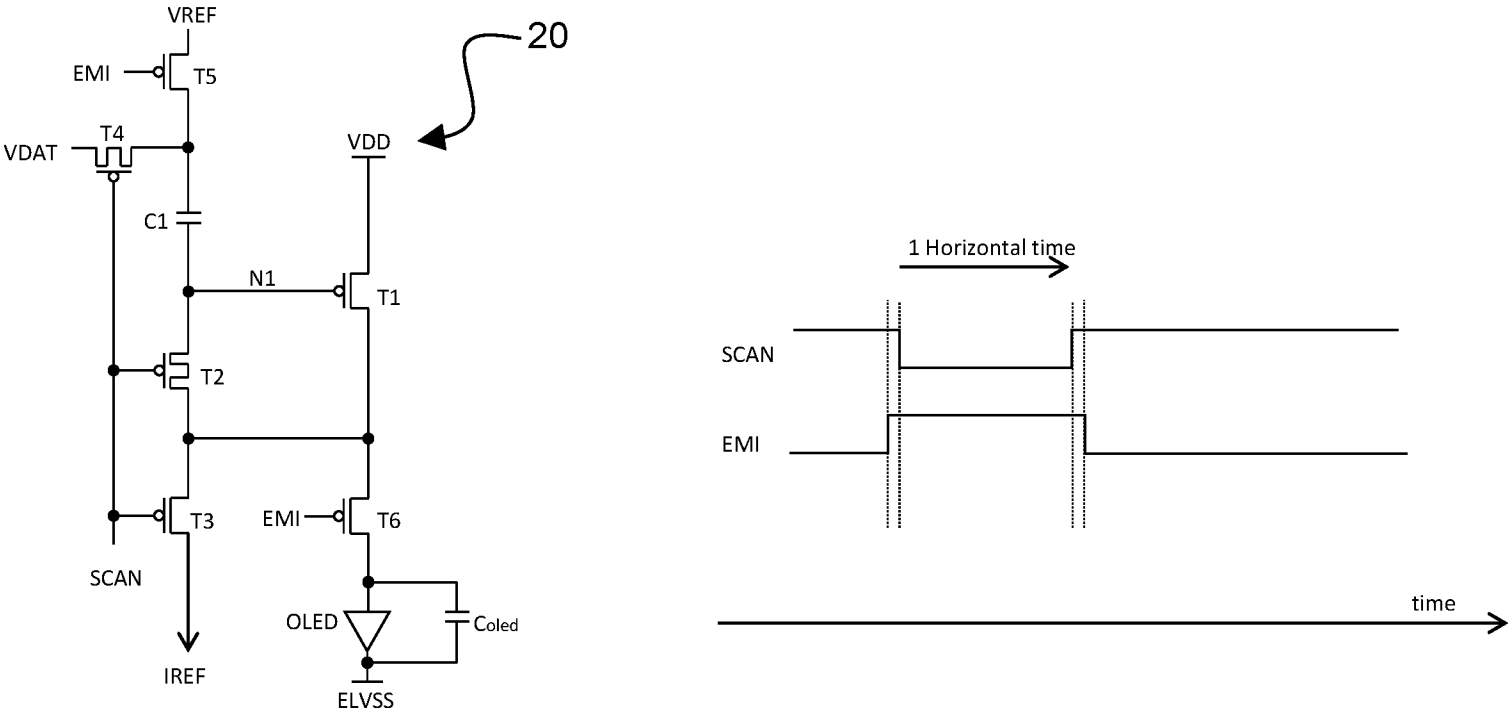
FIG. 2 is a drawing depicting a second circuit configuration in accordance with embodiments of the present invention, and an associated timing diagram.

FIG. 2 is a drawing depicting a second circuit configuration 20 in accordance with embodiments of the present invention, and an associated timing diagram. Similar to the previous embodiment, FIG. 2 depicts the TFT circuit 20 configured with p-MOS or p-type TFTs. T1 is a drive transistor that is an analogue TFT, and T2-T6 are digital switch TFTs. In this exemplary embodiment, T2 and T4 again are double-gate TFTs as a preferred embodiment, although T2 and T4 alternatively may be single gate TFTs. C1 is a capacitor, and $C_{oled}$ represents the internal capacitance of the OLED device.

The difference between the pixel circuit configuration of TFT circuit 10 (FIG. 1) and TFT circuit 20 (FIG. 2) is that in TFT circuit 20, a reference second voltage supply VREF is connectable to the top (second) plate of the capacitor C1 as further detailed below. The reference voltage may be a second power supply VREF that is separate from the first power supply VDD which is connected through the drive transistor T1.

The circuit operation of TFT circuit 20 otherwise is largely comparable as for TFT circuit 10. In the combined programming and compensation phase, the emission signal EMI is changed from a low voltage level to a high voltage level, causing transistors T5 and T6 to be turned off. Hence, the OLED device is isolated from the drive transistor T1, and current to the OLED device is cut off so there is no light emission from the OLED device during the remainder of the combined programming and compensation phase. Additionally, the top plate of the capacitor C1 becomes disconnected from separate reference second power supply VREF. The SCAN signal is changed from a high voltage level to a low voltage level, causing digital switch transistors T2, T3, and T4 to be turned on. When transistor T2 is turned on, the drive transistor T1 is diode-connected through transistor T2 by connecting the gate of T1 to a second terminal (e.g., drain) of T1 through transistor T2. When transistor T3 is turned on, the reference current IREF is sunk through the diode-connected drive transistor T1 from the power supply VDD. When transistor T4 is turned on, the top plate of capacitor C1 is connected to VDAT.

Second, during the emission phase, the SCAN signal is changed from a low voltage level to a high voltage level, causing transistors T2, T3 and T4 to be turned off. When transistor T2 is turned off, the gate and drain of the drive transistor T1 are disconnected from each other. The node at N1 then becomes floating, which thereby results in a floating connection between the bottom plate of the capacitor C1 and the gate of the drive transistor T1. When transistor T3 is turned off, the reference current is cut off from the pixel TFT circuit 20. When transistor T4 is turned off, the top plate of the capacitor is disconnected from the data voltage, VDAT. Next the EMI signal is changed from a high voltage level to a low voltage level, causing the transistors T5 and T6 to be turned on. When transistor T5 is turned on, the top plate of the capacitor is connected to the reference second power supply VREF, and this causes the voltage at the top plate of the capacitor to change by a voltage equal to is $V_{REF}-V_{DAT}$. As the bottom plate of the capacitor C1 is floating, the voltage of the bottom plate follows the change of the top plate as does the voltage at the gate of transistor T1. When transistor T6 is turned on, the OLED is connected to the drive transistor T1 through the switching transistor T6. The carrier mobility and threshold voltages of the drive transistor T1 are compensated as described above.

In the example of FIG. 2, the output current during emission will be $$I_{OLED} = \frac{\mu_n C_{ox} W/L}{2}\left(\sqrt{\frac{2I_{ref}}{\mu_n C_{ox} W/L}} + V_{ref} - V_{DAT}\right)^2$$

An advantage of this embodiment is that the IR-drop on the power supply VDD, line has no effect on the $I_{OLED}$.

Figure 3:
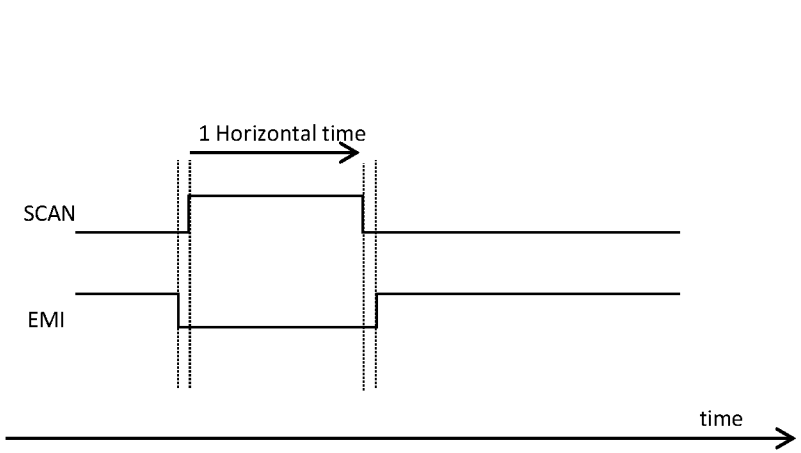
FIG. 3 is a drawing depicting a third circuit configuration in accordance with embodiments of the present invention, and an associated timing diagram.
Figure 3:
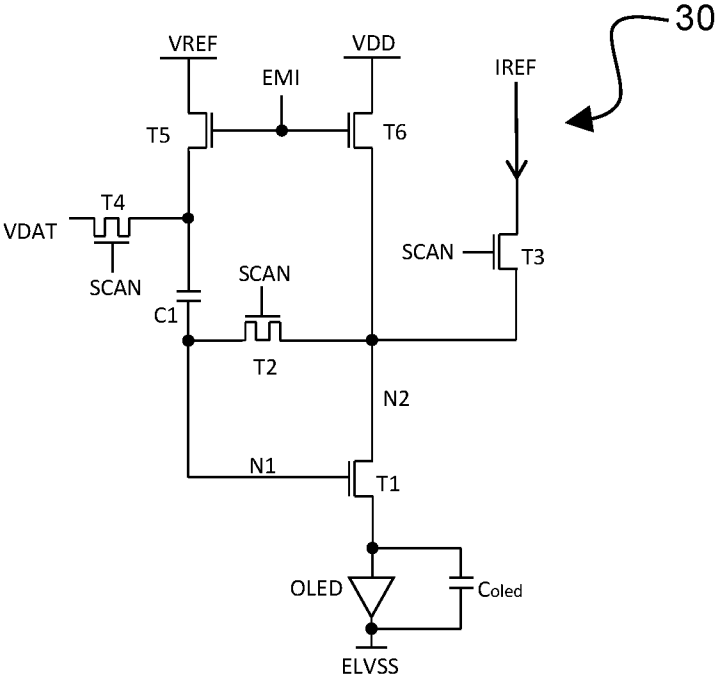

FIG. 3 is a drawing depicting a third circuit configuration 30 in accordance with embodiments of the present invention, and an associated timing diagram. FIG. 3 depicts the TFT circuit 30 configured with n-type TFTs. Similarly as in previous embodiments, T1 is a drive transistor that is an analogue TFT, and T2-T6 are digital switch TFTs. In this exemplary embodiment, T2 and T4 again are double-gate TFTs as a preferred embodiment, although T2 and T4 alternatively may be single gate TFTs. C1 is a capacitor, and $C_{oled}$ represents the internal capacitance of the OLED device.

By employing n-type TFTs, operation of the TFT circuit 30 proceeds as follows. First, in the combined programming and compensation phase, the EMI signal is changed from a high voltage level to a low voltage level, causing the transistors T5 and T6 to be turned off. As a consequence, the drive transistor T1 is isolated from the power supply, VDD, and the top plate of the capacitor C1 is disconnected from the separate second power supply VREF. The SCAN signal is changed from a low voltage level to a high voltage level, causing the transistors T2, T3 and T4 to be turned on. When transistor T2 is turned on, the drive transistor T1 is diode-connected through transistor T2 by connecting the gate of T1 to a second terminal of T1 through transistor T2. When transistor T3 is turned on, the reference current $I_{REF}$ is sunk through diode-connected drive transistor T1 to the OLED device. When the current through drive transistor T1 and the voltage at the gate of the drive transistor T1 become constant, the following equations represent the current and voltage relationships for the drive transistor T1, with the parameters as identified above.

$$I_{ref} = \frac{\mu_n C_{ox} W/L}{2}(V_{GS} - V_{TH})^2 = \frac{\mu_n C_{ox} W/L}{2}(V_{N1} - V_{OLED} - V_{TH})^2$$

$$V_{N1} = \sqrt{\frac{2I_{ref}}{\mu_n C_{ox} W/L}} + V_{OLED} + V_{TH}$$

Similarly as in previous embodiments, the voltage at the capacitor C1 bottom plate (at node N1), $V_{N1}$, includes a sum of a voltage related to the carrier mobility of T1 and a voltage related to the threshold voltage of T1. $V_{OLED}$ is the voltage across the OLED device when the current through the OLED is equal to $I_{ref}$. With transistor T4 turned on, the data voltage, VDAT, is applied at the top plate of the capacitor C1. The voltage across the capacitor C1 between the top and bottom plates is:

$$V_{DAT} - V_{N1} = V_{DAT} - \left(\sqrt{\frac{2I_{ref}}{\mu_n C_{ox} W/L}} + V_{OLED} + V_{TH}\right)$$

Second, during the emission phase, the SCAN signal is changed from a high voltage level to a low voltage level, causing the transistor T2, T3 and T4 to be turned off. When transistor T2 is turned off, the transistor T1 is no longer diode-connected. The node at N1 then becomes floating, which thereby creates a floating connection between the bottom plate of the capacitor C1 and the gate of the drive transistor T1. When transistor T3 is turned off, the reference current is cut off from the pixel circuit 30. When transistor T4 is turned off, the top plate of the capacitor C1 is disconnected from the data voltage, VDAT. Next, the EMI signal is changed from a low voltage level to a high voltage level, causing the transistors T5 and T6 to be turned on. When transistor T5 is turned on, the top plate of the capacitor C1 is connected to the reference second power supply VREF. The voltage change at the top plate of the capacitor is $V_{REF}-V_{DAT}$. As the bottom plate of the capacitor C1 is floating, the voltage of the bottom plate follows the voltage change of the top plate. Therefore, the voltage at the capacitor bottom plate ($V_{N1}$), and hence the gate of the drive transistor T1 becomes:

$$V_{N1} + (V_{REF} - V_{DAT}) = \sqrt{\frac{2I_{ref}}{\mu_n C_{ox} W/L}} + V_{OLED} + V_{TH} + V_{REF} - V_{DAT}$$

When transistor T6 is turned on, the power supply VDD is connected to drive transistor T1 through the switching transistor T6. The current will flow from the power supply, VDD, to the OLED device. The amount of current is $$I_{OLED} = \frac{\mu_n C_{ox} W/L}{2}(V_{GS} - V_{TH})^2 = \frac{\mu_n C_{ox} W/L}{2}(V_{N1} - V_{OLED} - V_{TH})^2 = \frac{\mu_n C_{ox} W/L}{2}\left(\sqrt{\frac{2I_{ref}}{\mu_n C_{ox} W/L}} + V_{OLED} + V_{TH} + V_{REF} - V_{DAT} - V_{OLED} - V_{TH}\right)^2 = \frac{\mu_n C_{ox} W/L}{2}\left(\sqrt{\frac{2I_{ref}}{\mu_n C_{ox} W/L}} + V_{REF} - V_{DAT}\right)^2$$

In view of the above, the drive transistor T1 threshold voltage, $V_{TH}$, has been compensated. The carrier mobility variation $\mu_n$ has been partially compensated. The $V_{OLED}$ term in the n-type TFT $I_{OLED}$ equation has been cancelled. $I_{OLED}$ is thus independent of $V_{OLED}$ variations after compensation. Hence the OLED voltage variations caused by aging and the manufacturing process also are compensated.

Figure 4:
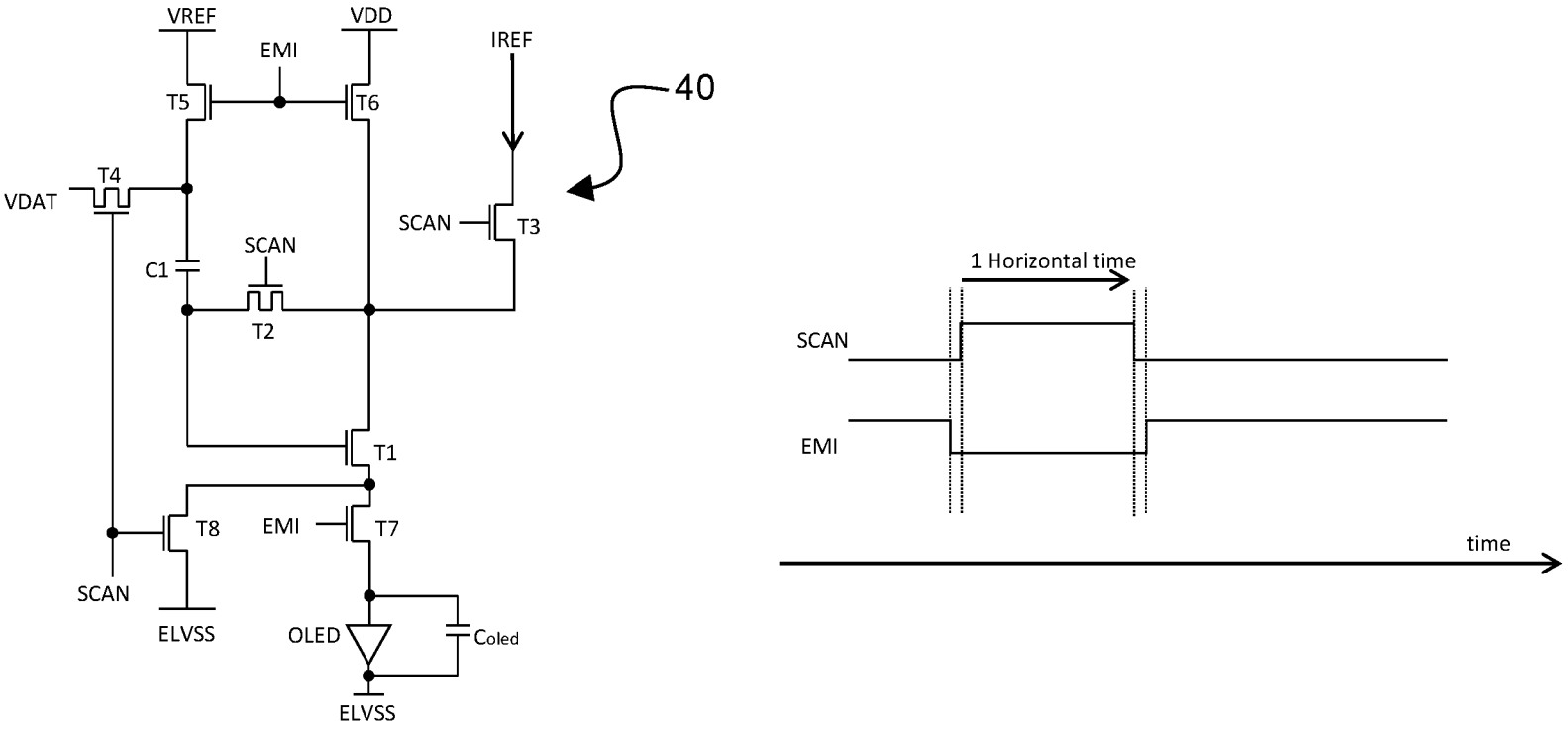
FIG. 4 is a drawing depicting a fourth circuit configuration in accordance with embodiments of the present invention, and an associated timing diagram.

FIG. 4 is a drawing depicting a fourth circuit configuration 40 in accordance with embodiments of the present invention, and an associated timing diagram. Similarly as in the embodiment of FIG. 3, FIG. 4 depicts the TFT circuit 40 configured with n-type TFTs. T1 is a drive transistor that is an analogue TFT, and T2-T8 are digital switch TFTs. In this exemplary embodiment, T2 and T4 again are double-gate TFTs as a preferred embodiment, although T2 and T4 alternatively may be single gate TFTs. C1 is a capacitor, and $C_{oled}$ represents the internal capacitance of the OLED device.

The difference between the pixel circuit configuration of TFT circuit 30 (FIG. 3) and TFT circuit 40 (FIG. 4) is that in TFT circuit 40, the reference current IREF does not flow through the OLED device. Rather, the reference current IREF flows flow through a switch transistor T8 to the third power supply ELVSS that also powers the OLED during the emission phase. An additional switch transistor T7 isolates the OLED device during the compensation and programming phase. In this way, there will no light emission during the compensation and programming phase, which may be an advantage for providing low brightness from the pixel.

The circuit operation of TFT circuit 40 otherwise is largely comparable as for TFT circuit 30. First, in the combined programming and compensation phase, the EMI signal is changed from a high voltage level to a low voltage level, causing the transistors T5, T6 and T7 to be turned off. As a consequence, the drive transistor T1 is isolated from the power supply, VDD, and the top plate of the capacitor C1 is disconnected from the reference second power supply VREF. The OLED further is isolated with T7 also being off. The SCAN signal is changed from a low voltage level to a high voltage level, causing the transistors T2, T3, T4, and T8 to be turned on. When transistor T2 is turned on, the drive transistor T1 is diode-connected through transistor T2 by connecting the gate of T1 to a second terminal of T1 through transistor T2. When transistor T3 and T8 are turned on, the reference current IREF is sunk through diode-connected drive transistor T1 to the OLED third power supply ELVSS through the switch transistor T8. When transistor T4 is turned on, the top plate of capacitor C1 is connected to VDAT.

Second, during the emission phase, the SCAN signal is changed from a high voltage level to a low voltage level, causing the transistors T2, T3, T4, and T8 to be turned off. When transistor T2 is turned off, the drive transistor T1 is no longer diode-connected. The bottom plate of the capacitor C1 then becomes floating, which thereby creates a floating connection between the bottom plate of the capacitor C1 and the gate of the drive transistor T1. When transistor T3 and T8 are turned off, the reference current is cut off from the pixel circuit 40, and $V_{ELVSS}$ is isolated from the drive transistor T1 through transistor T8. When transistor T4 is turned off, the top plate of the capacitor C1 is disconnected from the data voltage, VDAT. Next, the EMI signal is changed from a low voltage level to a high voltage level, causing the transistors T5, T6, and T7, to be turned on. When transistor T5 is turned on, the top plate of the capacitor C1 is connected to the reference second power supply VREF. The voltage change at the top plate of the capacitor C1 is $V_{REF}-V_{DAT}$. As the bottom plate of the capacitor C1 is floating, the voltage of the bottom plate follows the voltage change of the top plate. When transistors T6 and T7 are turned on, the power supply VDD is connected to the drive transistor T1 through the switching transistor T6 and ultimately to the OLED via the switching transistor T7. The carrier mobility and threshold voltages of the drive transistor T1 are compensated as described above.

The output current during emission will be:

$$I_{OLED} == \frac{\mu_n C_{ox} W/L}{2}\left(\sqrt{\frac{2I_{ref}}{\mu_n C_{ox} W/L}} + V_{ELVSS} + V_{REF} - V_{OLED} - V_{DAT}\right)^2$$

Figure 5:
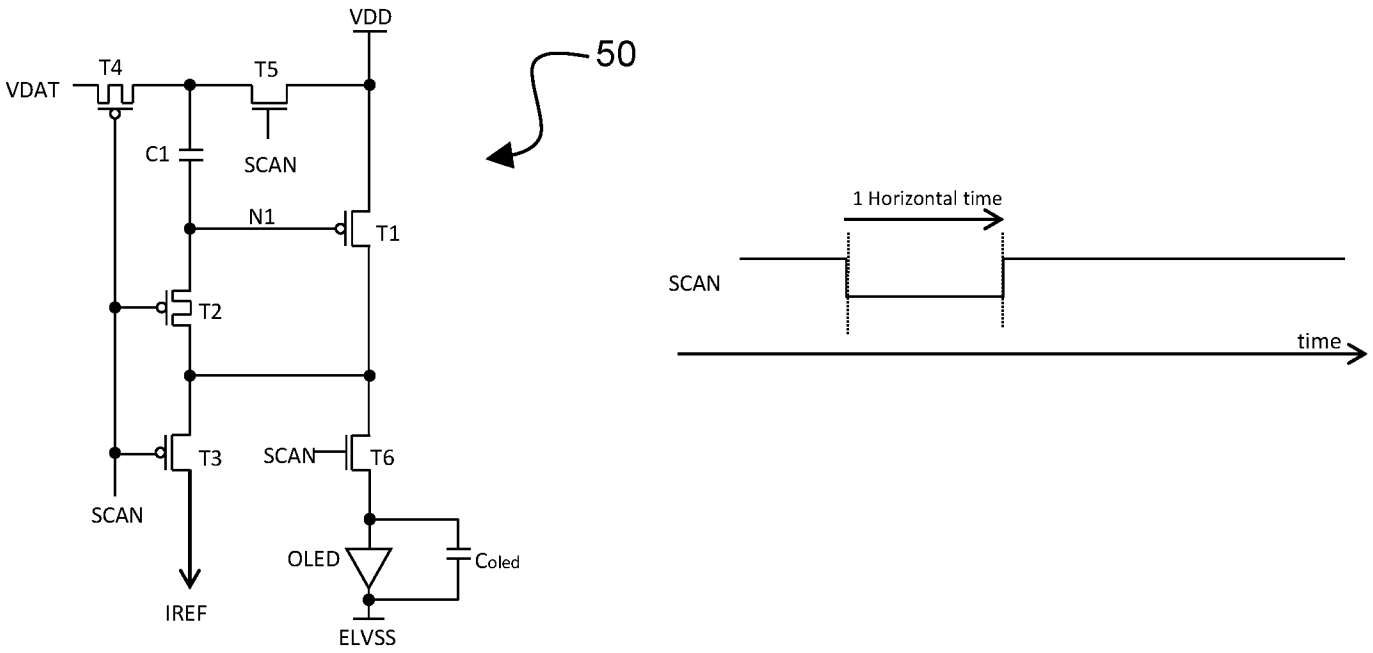
FIG. 5 is a drawing depicting a fifth circuit configuration in accordance with embodiments of the present invention, and an associated timing diagram.

FIG. 5 is a drawing depicting a fifth circuit configuration 50 in accordance with embodiments of the present invention, and an associated timing diagram. FIG. 5 depicts the TFT circuit 50 configured similarly as the TFT circuit 10 of FIG. 1, except configured with a combination of p-type TFTs (T1, T2, T3, and T4) and n-type TFTs (T5 and T6). Similarly as in previous embodiments, T1 is a drive transistor that is an analogue TFT, and T2-T6 are digital switch TFTs. T2 and T4 again are double-gate TFTs as a preferred embodiment, although T2 and T4 alternatively may be single gate TFTs. C1 is a capacitor, and $C_{oled}$ represents the internal capacitance of the OLED device.

The operation of TFT circuit 50 of FIG. 5 is comparable to the operation of TFT circuit 10 of FIG. 1. The principal difference is that in TFT circuit 50, switch transistor T5 and switch transistor T6 are changed from p-type transistors to n-type transistors. Advantageously, such embodiment requires only one control signal SCAN to turn off or turn on switch transistors T5 and T6 during operations.

In the combined programming and compensation phase, the SCAN signal is changed from a high voltage level to a low voltage level, causing transistors T5 and T6 to be turned off. Hence, the OLED device is isolated from the drive transistor T1, and current to the OLED device is cut off so there is no light emission from the OLED device during the remainder of the combined programming and compensation phase. Additionally, the top plate of the capacitor C1 becomes disconnected from the power supply VDD. The SCAN signal switch from high to low further causes digital switch transistors T2, T3, and T4 to be turned on. When transistor T2 is turned on, the drive transistor T1 is diode-connected through transistor T2 by connecting the gate of T1 to a second terminal of T1 through transistor T2. When transistor T3 is turned on, the reference current IREF is sunk through the diode-connected drive transistor T1 from the power supply VDD. When transistor T4 is turned on, the top plate of capacitor C1 is connected to VDAT.

Second, during the emission phase, the SCAN signal is changed from a low voltage level to a high voltage level, causing transistors T2, T3 and T4 to be turned off. When transistor T2 is turned off, the gate and drain of the drive transistor T1 are disconnected from each other. The node at N1 then becomes floating, which thereby creates a floating connection between the bottom plate of the capacitor C1 and the gate of the drive transistor T1. When transistor T3 is turned off, the reference current is cut off from the pixel circuit 50. When transistor T4 is turned off, the top plate of the capacitor C1 is disconnected from the data voltage VDAT. The switch of the SCAN signal from low to high further causes the transistors T5 and T6 to be turned on. When transistor T5 is turned on, the top plate of the capacitor C1 is connected to the power supply VDD, and this causes the voltage at the top plate of the capacitor to change by a voltage equal to is $V_{DD}-V_{DAT}$. As the bottom plate of the capacitor C1 is floating, the voltage of the bottom plate and thus the gate of the drive transistor T1 follows the change of the top plate. When transistor T6 is turned on, the power supply VDD is connected to the OLED via the drive transistor T1 and through the switching transistor T6. The carrier mobility and threshold voltages of the drive transistor T1 are compensated as described above.

Figure 6:
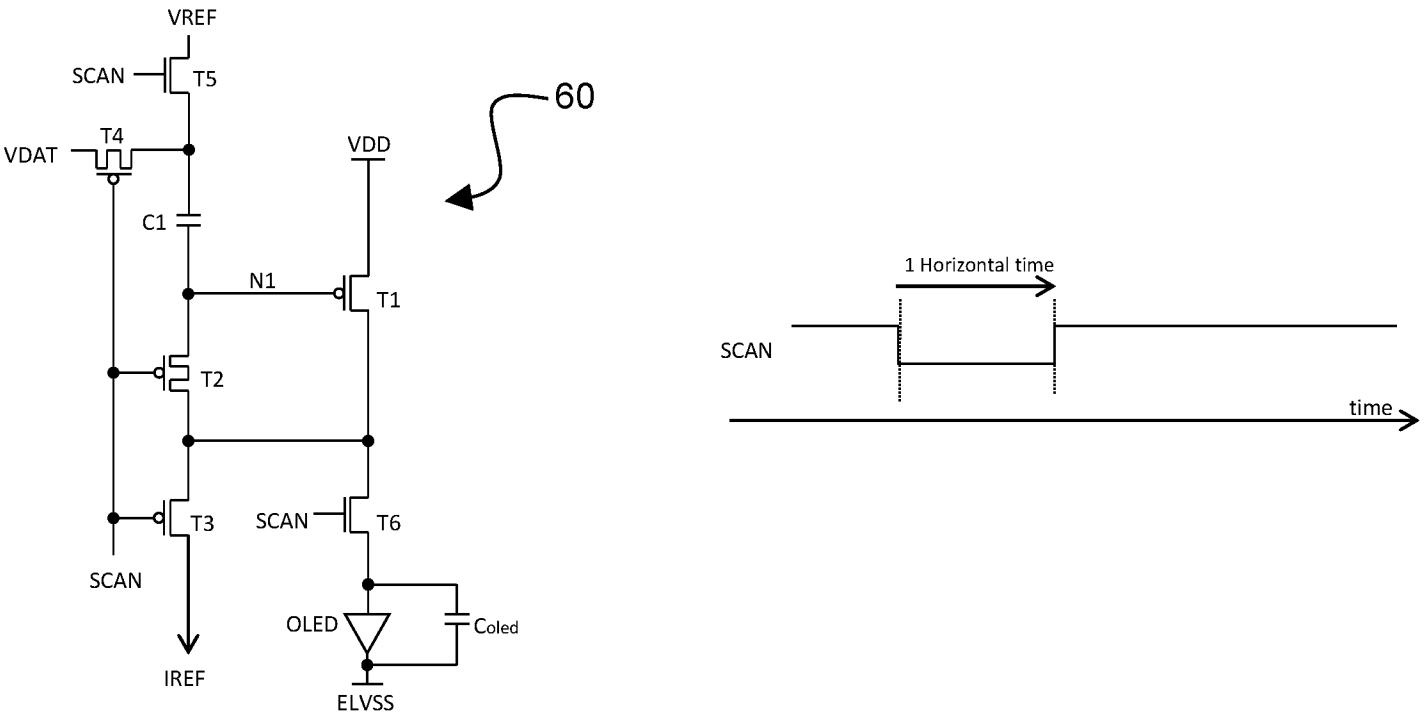
FIG. 6 is a drawing depicting a sixth circuit configuration in accordance with embodiments of the present invention, and an associated timing diagram.

FIG. 6 is a drawing depicting a sixth circuit configuration 60 in accordance with embodiments of the present invention, and an associated timing diagram. FIG. 6 depicts the TFT circuit 60 configured similarly as the TFT circuit 20 of FIG. 2, except configured with a combination of p-type TFTs (T1, T2, T3, and T4) and n-type TFTs (T5 and T6). Similarly as in previous embodiments, T1 is a drive transistor that is an analogue TFT, and T2-T6 are digital switch TFTs. T2 and T4 again are double-gate TFTs as a preferred embodiment, although T2 and T4 alternatively may be single gate TFTs. C1 is a capacitor, and $C_{oled}$ represents the internal capacitance of the OLED device.

The operation of TFT circuit 60 is comparable to the operation of TFT circuit 20 of FIG. 2. The principal difference is that in TFT circuit 60, switch transistor T5 and switch transistor T6 are changed from p-type transistors to n-type transistors (similarly as in the configuration of FIG. 5). Advantageously, such embodiment also requires only one control signal SCAN to turn off or turn on switch transistors T5 and T6 during operations.

In the combined programming and compensation phase, the SCAN signal is changed from a high voltage level to a low voltage level, causing transistors T5 and T6 to be turned off. Hence, the OLED device is isolated from the drive transistor T1, and current to the OLED device is cut off so there is no light emission from the OLED device during the remainder of the combined programming and compensation phase. Additionally, the top plate of the capacitor becomes disconnected from the reference second power supply VREF. The SCAN signal switch from high to low further causes digital switch transistors T2, T3, and T4 to be turned on. When transistor T2 is turned on, the drive transistor T1 is diode-connected through transistor T2 by connecting the gate of T1 to a second terminal of T1 through transistor T2. When transistor T3 is turned on, the reference current IREF is sunk through the diode-connected drive transistor T1 from the power supply VDD. When transistor T4 is turned on, the top plate of capacitor C1 is connected to VDAT.

Second, during the emission phase, the SCAN signal is changed from a low voltage level to a high voltage level, causing transistors T2, T3 and T4 to be turned off. When transistor T2 is turned off, the gate and drain of the drive transistor T1 are disconnected from each other. The node at N1 then becomes floating, which thereby creates a floating connection between the bottom plate of the capacitor C1 and the gate of the drive transistor T1. When transistor T3 is turned off, the reference current is cut off from the pixel circuit 20. When transistor T4 is turned off, the top plate of the capacitor C1 is disconnected from the data voltage VDAT. The switch of the SCAN signal from low to high further causes the transistors T5 and T6 to be turned on. When transistor T5 is turned on, the top plate of the capacitor C1 is connected to the reference second power supply VREF, and this causes the voltage at the top plate of the capacitor C1 to change by a voltage equal to is $V_{REF}-V_{DAT}$. As the bottom plate of the capacitor C1 is floating, the voltage of the bottom plate and the gate of the drive transistor T1 follows the change of the top plate. When transistor T6 is turned on, the power supply VDD is connected to the OLED via the drive transistor T1 through the switching transistor T6. The carrier mobility and threshold voltages of the drive transistor T1 are compensated as described above.

Figure 7:
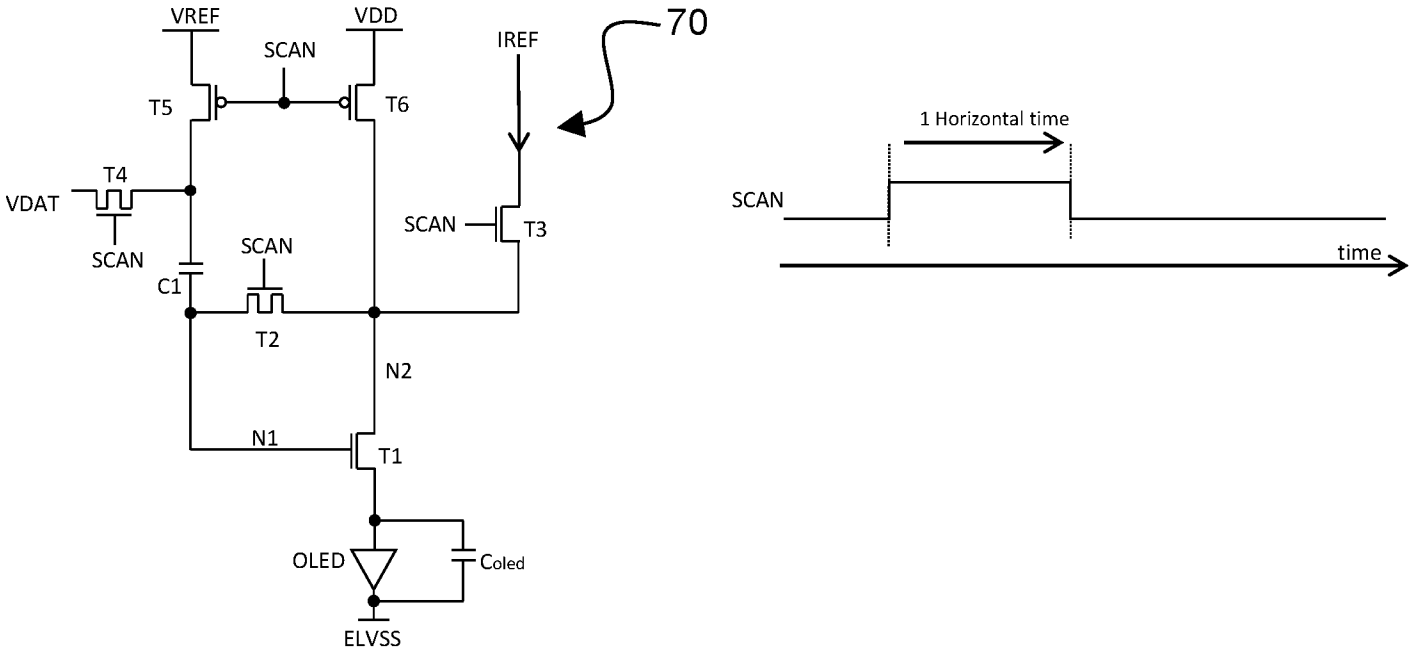
FIG. 7 is a drawing depicting a seventh circuit configuration in accordance with embodiments of the present invention, and an associated timing diagram.

FIG. 7 is a drawing depicting a seventh circuit configuration 70 in accordance with embodiments of the present invention, and an associated timing diagram. FIG. 7 depicts the TFT circuit 70 configured similarly as the TFT circuit 30 of FIG. 3, except configured with a combination of p-type TFTs (T5 and T6) and n-type TFTs (T1, T2, T3, and T4). Similarly as in previous embodiments, T1 is a drive transistor that is an analogue TFT, and T2-T6 are digital switch TFTs. T2 and T4 again are double-gate TFTs as a preferred embodiment, although T2 and T4 alternatively may be single gate TFTs. C1 is a capacitor, and $C_{oled}$ represents the internal capacitance of the OLED device.

The operation of TFT circuit 70 is comparable to the operation of TFT circuit 30 of FIG. 3. The principal difference is that in TFT circuit 70, switch transistor T5 and switch transistor T6 are changed from n-type transistors to p-type transistors. Advantageously, such embodiment also requires only one control signal SCAN to turn off or turn on switch transistors T5 and T6 during operations.

In the combined programming and compensation phase, the SCAN signal is changed from a low voltage level to a high voltage level, causing transistors T5 and T6 to be turned off. Hence, the OLED device is isolated from VDD, and current to the OLED device is cut off so there is no light emission from the OLED device during the remainder of the combined programming and compensation phase. Additionally, the top plate of the capacitor C1 becomes disconnected from the reference second power supply VREF. The SCAN signal switch from low to high further causes digital switch transistors T2, T3, and T4 to be turned on. When transistor T2 is turned on, the drive transistor T1 is diode-connected through transistor T2 by connecting the gate of T1 to a second terminal of T1 through transistor T2. When transistor T3 is turned on, the reference current IREF is sunk through the diode-connected drive transistor T1. When transistor T4 is turned on, the top plate of capacitor C1 is connected to VDAT.

Second, during the emission phase, the SCAN signal is changed from a high voltage level to a low voltage level, causing transistors T2, T3 and T4 to be turned off. When transistor T2 is turned off, the drive transistor T1 is no longer diode-connected. The bottom plate of capacitor C1 then becomes floating, which thereby creates a floating connection between the bottom plate of the capacitor C1 and the gate of the drive transistor T1. When transistor T3 is turned off, the reference current is cut off from the pixel circuit 70. When transistor T4 is turned off, the top plate of the capacitor C1 is disconnected from the data voltage VDAT. The switch of the SCAN signal from high to low further causes the transistors T5 and T6 to be turned on. When transistor T5 is turned on, the top plate of the capacitor C1 is connected to the reference second power supply VREF, and this causes the voltage at the top plate of the capacitor C1 to change by a voltage equal to is $V_{REF}-V_{DAT}$. As the bottom plate of the capacitor C1 is floating, the voltage of the bottom plate and at the gate of the drive transistor T1 follows the change of the top plate. When transistor T6 is turned on, the power supply VDD is connected to drive transistor T1 through the switching transistor T6, and ultimately to the OLED. The carrier mobility and threshold voltages of the drive transistor T1 are compensated as described above.

Figure 8:
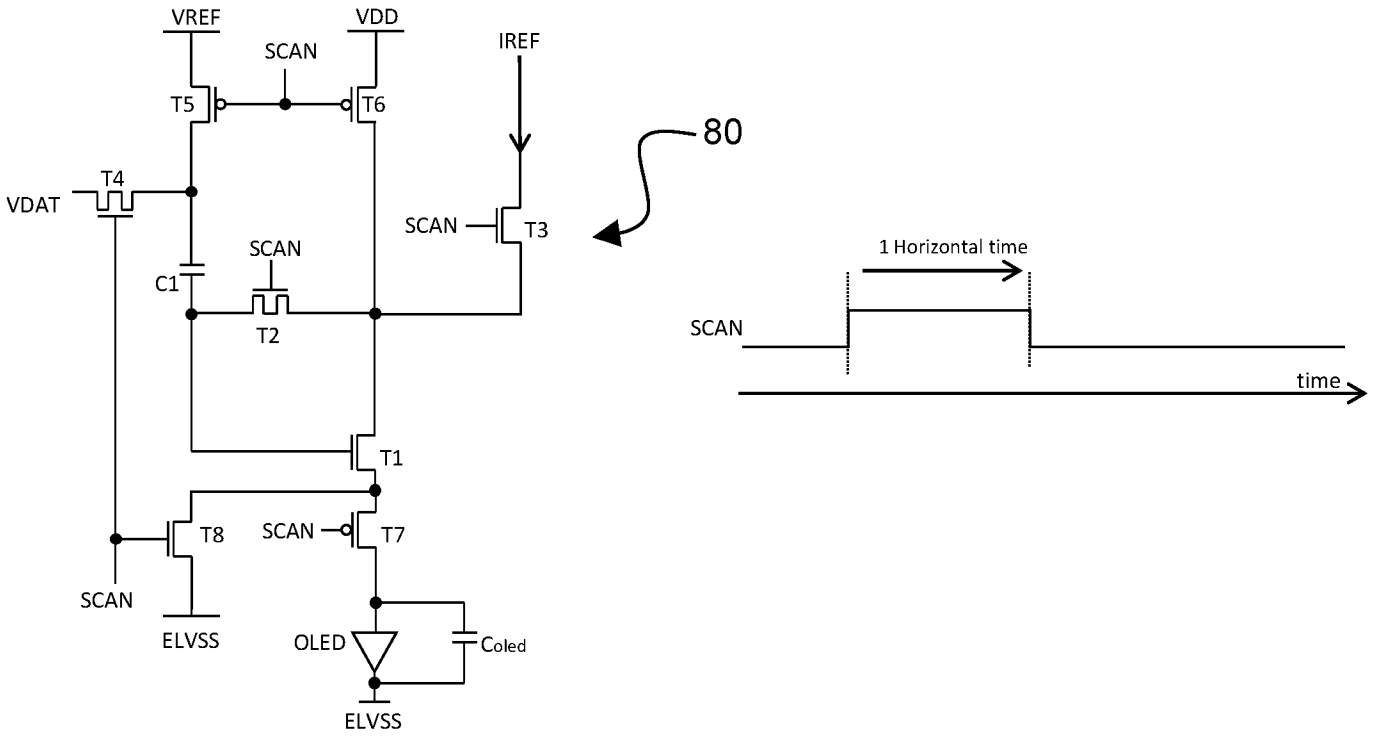
FIG. 8 is a drawing depicting an eighth circuit configuration in accordance with embodiments of the present invention, and an associated timing diagram.

FIG. 8 is a drawing depicting an eighth circuit configuration 80 in accordance with embodiments of the present invention, and an associated timing diagram. FIG. 8 depicts the TFT circuit 80 configured similarly as the TFT circuit 40 of FIG. 4, except configured with a combination of p-type TFTs (T5, T6, and T7) and n-type TFTs (T1, T2, T3, T4 and T8). Similarly as in previous embodiments, T1 is a drive transistor that is an analogue TFT, and T2-T8 are digital switch TFTs. T2 and T4 again are double-gate TFTs as a preferred embodiment, although T2 and T4 alternatively may be single gate TFTs. C1 is a capacitor, and $C_{oled}$ represents the internal capacitance of the OLED device.

The operation of TFT circuit 80 is comparable to the operation of TFT circuit 40 of FIG. 4. The principal difference is that in TFT circuit 80, switch transistors, T5, T6, and T7 are changed from n-type transistors to p-type transistors. Advantageously, such embodiment also requires only one control signal SCAN to turn off or turn on switch transistors T5, T6, and T7 during operations.

In the combined programming and compensation phase, the SCAN signal is changed from a low voltage level to a high voltage level, causing the transistors T5, T6, and T7 to be turned off. As a consequence, the drive transistor T1 is isolated from the power supply, VDD, and the top plate of the capacitor C1 is disconnected from the reference second power supply VREF. The OLED further is isolated with T7 also being off. The SCAN switch form low to high further causes the transistors T2, T3, T4, and T8 to be turned on. When transistor T2 is turned on, the drive transistor T1 is diode-connected through transistor T2 by connecting the gate of T1 to a second terminal of T1 through transistor T2. When transistor T3 and T8 are turned on, the reference current IREF is sunk through diode-connected drive transistor T1 and transistor T8 to the third power supply ELVSS device. When transistor T4 is turned on, the top plate of capacitor C1 is connected to VDAT.

Second, during the emission phase, the SCAN signal is changed from a high voltage level to a low voltage level, causing the transistor T2, T3, T4, and T8 to be turned off. When transistor T2 is turned off, the drive transistor T1 is no longer diode-connected. The bottom plate of the capacitor C1 then becomes floating, which thereby floats the voltage at the gate of the drive transistor T1. When transistors T3 and T8 are turned off, the reference current is cut off from the pixel TFT circuit 80. When transistor T4 is turned off, the top plate of the capacitor C1 is disconnected from the data voltage, VDAT. The switch of the SCAN signal from high to low further causes transistors T5, T6, and T7 to be turned on. When transistor T5 is turned on, the top plate of the capacitor C1 is connected to the reference second power supply VREF. The voltage change at the top plate of the capacitor is $V_{REF}-V_{DAT}$. As the bottom plate of the capacitor C1 is floating, the voltage of the bottom plate and of the gate of the drive transistor T1 follows the voltage change of the top plate. When transistors T6 and T7 are turned on, the power supply VDD is connected to the drive transistor T1 through the switching transistor T6, and VDD ultimately to the OLED via the switching transistor T7. The carrier mobility and threshold voltages of the drive transistor T1 are compensated as described above.

Compared to conventional circuit configurations, the circuit configurations of the present disclosure have advantages. In the circuit configurations of the present disclosure, compensation and programming occur simultaneously in a single phase. This is advantageous for completing the compensation and programming steps in a shorter time, i.e., the horizontal time (1H) is shortened. A short 1H time is a requirement for displays with a large number of pixels in a column, as is necessary for high-resolution displays (high pixels per inch or ppi). In addition, the disclosed circuit configurations use only one capacitor C1 in the pixel circuit configurations, compared with conventional circuits that need at least two capacitors. This means that the total area of the disclosed circuit may be smaller as compared to conventional configurations. This likewise is advantageous for displays with high resolution (high ppi), in which the individual pixels must be as small as practicable.

The various embodiments have been described in connection with OLEDs as the display light-emitting device. The circuit configurations, however, are not limited to any particular display technology. For example, the circuit configurations also may also be used for micro LED displays, quantum dot LED displays, or any other device which emits light in response to an applied electrical bias. A micro LED, for example, is a semiconductor device containing a p-type region, an n-type region and a light emission region, for example formed on a substrate and divided into individual chips. A micro LED may be based on a III-nitride semiconductor. A quantum dot LED, for example, is a device containing a hole transport layer, an electron transport layer, and a light emission region, wherein the light emission regions contains nanocrystalline quantum dots. The circuit configurations, described herein may be employed for any such display technologies.

An aspect of the invention, therefore, is a pixel circuit for a display device that is operable in a combined programming and compensation phase, and operable in an emission phase. In exemplary embodiments, the pixel circuit includes a drive transistor configured to control an amount of current to the light-emitting device during the emission phase depending upon a voltage applied to a gate of the drive transistor; a second transistor connected to the gate of the drive transistor, wherein the second transistor is in an on state during the combined programming and compensation phase and in an off state during the emission phase, and when the second transistor is in the on state the drive transistor becomes diode-connected such that the gate and a second terminal of the drive transistor are connected through the second transistor; a third transistor connected to the second terminal of the drive transistor, wherein the third transistor is in an on state during the combined programming and compensation phase to permit a reference current to be applied through the drive transistor, and is in an off state during the emission phase to remove the reference current; and a capacitor having a first plate that is connected to the gate of the drive transistor and a second plate that is connectable to a data voltage VDAT during the combined programming and compensation phase. A threshold voltage and/or a carrier mobility of the drive transistor are at least partially compensated by application of the reference current during the combined programming and compensation phase. The pixel circuit may include one or more of the following features, either individually or in combination.

In an exemplary embodiment of the pixel circuit, the pixel circuit further includes a fourth transistor that is connected to the second plate of the capacitor, wherein the fourth transistor is in an on state during the combined programming and compensation phase to apply VDAT to the second plate of the capacitor, and the fourth transistor is in an off state during the emission phase to isolate VDAT from the second plate of the capacitor; a fifth transistor that is connectable to a voltage supply and is connected to the second plate of the capacitor, wherein the fifth transistor is in an off state during the combined programming and compensation phase to isolate the second plate of the capacitor from the voltage supply, and the fifth transistor is in the on state during the emission phase to connect the voltage supply to the second plate of the capacitor; and a sixth transistor that is in an off state during the combined programming and compensation phase to stop the flow of the reference current to the light-emitting device from the pixel circuit, and is in an on state during the emission phase to permit current that flows through the drive transistor to flow to the light-emitting device.

In an exemplary embodiment of the pixel circuit, the drive transistor is connectable to a first voltage supply, and the fifth transistor is connectable to a reference second voltage supply; and wherein the fifth transistor is in the off state during the combined programming and compensation phase to isolate the second plate of the capacitor from the reference second voltage supply, and the fifth capacitor is in the on state during the emission phase to connect the reference second voltage supply to the second plate of the capacitor.

In an exemplary embodiment of the pixel circuit, the third transistor and the first transistor are configured for the reference current to flow to the light-emitting device during the combined programming and compensation to compensate for voltage variations of the light-emitting device.

In an exemplary embodiment of the pixel circuit, the drive transistor and the second through sixth transistors are all p-type transistors.

In an exemplary embodiment of the pixel circuit, the drive transistor and the second through sixth transistors are all n-type transistors.

In an exemplary embodiment of the pixel circuit, the drive transistor and the second through fourth transistors are p-type transistors, and the fifth and sixth transistors are n-type transistors.

In an exemplary embodiment of the pixel circuit, the drive transistor and the second through fourth transistors are n-type transistors, and the fifth and sixth transistors are p-type transistors.

In an exemplary embodiment of the pixel circuit, the sixth transistor is connected between the second terminal of the drive transistor and an output to the light-emitting device.

In an exemplary embodiment of the pixel circuit, the sixth transistor is connected between the second terminal of the drive transistor and an input from a voltage supply.

Another aspect of the invention is a method of operating a pixel circuit for a display device that is operable in a combined programming and compensation phase, and operable in an emission phase. In exemplary embodiments, the operating method includes the steps of providing a pixel circuit in accordance with any of the embodiments. During the combined programming and compensation phase, the method includes at least partially compensating a threshold voltage and/or a carrier mobility of the drive transistor by application of a reference current by the steps of: placing the second transistor in an on state, wherein the drive transistor becomes diode-connected such that the gate and the second terminal of the drive transistor are connected through the second transistor; placing the third transistor in an on state to permit the reference current to be applied through the drive transistor; and applying a data voltage VDAT to the second plate of the capacitor. During the emission phase, the method includes placing the second transistor in an off state; placing the third transistor in an off state to remove the reference current; isolating the second plate of the capacitor from VDAT and connecting the voltage supply to the second plate of the capacitor; and controlling an amount of current to the light-emitting device depending upon a voltage applied to a gate of a drive transistor. The operating method may include one or more of the following features, either individually or in combination.

In an exemplary embodiment of the operating method, the method further comprising the steps of during the combined programming and compensation phase: placing the fourth transistor in an on state to apply VDAT to the second plate of the capacitor; placing the fifth transistor in an off state to isolate the second plate of the capacitor from the voltage supply; and placing the sixth transistor in an off state to isolate the light-emitting device from the pixel circuit; and during the emission phase: placing the fourth transistor in an off state to isolate VDAT from the second plate of the capacitor; placing the fifth capacitor in an on state to connect the voltage supply to the second plate of the capacitor; and placing the sixth transistor in an on state to permit current that flows through the drive transistor to flow to the light-emitting device.

In an exemplary embodiment of the operating method, the drive transistor is connectable to a first voltage supply, and the fifth transistor is connectable to a reference second voltage supply; the method further comprising the steps of: during the combined programming and compensation phase, placing the fifth transistor in the off state to isolate the second plate of the capacitor from the reference second voltage supply; and during the emission phase placing the fifth transistor in the on state to connect the reference second voltage supply to the second plate of the capacitor; wherein an IR-drop in the first voltage supply is eliminated.

In an exemplary embodiment of the operating method, the third transistor and the first transistor are configured to apply the reference current to the light-emitting device, the operating method further comprising compensating for voltage variations of the light-emitting device by applying the reference current to the light-emitting device during the combined programming and compensation phase.

In an exemplary embodiment of the operating method, the drive transistor and the second through sixth transistors are all p-type transistors, the operating method further comprising the steps of: during the combined programming and compensation phase, taking an emission signal EMI applied to the fifth and sixth transistors from a low voltage level to a high voltage level, and taking a scan signal SCAN applied to the second through fourth transistors from a high voltage level to a low voltage level; and during the emission phase, taking the EMI applied to the fifth and sixth transistors from the high voltage level to the low voltage level, and taking the SCAN applied to the second through fourth transistors from the low voltage level to the high voltage level.

In an exemplary embodiment of the operating method, the drive transistor and the second through sixth transistors are all n-type transistors, the operating method further comprising the steps of: during the combined programming and compensation phase, taking an emission signal EMI applied to the fifth and sixth transistors from a high voltage level to a low voltage level, and taking a scan signal SCAN applied to the second through fourth transistors from a low voltage level to a high voltage level; and during the emission phase, taking the EMI applied to the fifth and sixth transistors from the low voltage level to the high voltage level, and taking the SCAN applied to the second through fourth transistors from the high voltage level to the low voltage level.

In an exemplary embodiment of the operating method, the drive transistor and the second through fourth transistors are p-type transistors, and the fifth and sixth transistors are n-type transistors, the operating method further comprising the steps of: during the combined programming and compensation phase, taking a scan signal SCAN applied to the second through sixth transistors from a high voltage level to a low voltage level; and during the emission phase, taking the SCAN applied to the second through sixth transistors from the low voltage level to the high voltage level.

In an exemplary embodiment of the operating method, the drive transistor and the second through fourth transistors are n-type transistors, and the fifth and sixth transistors are p-type transistors, the operating method further comprising the steps of: during the combined programming and compensation phase, taking a scan signal SCAN applied to the second through sixth transistors from a low voltage level to a high voltage level; and during the emission phase, taking the SCAN applied to the second through sixth transistors from the high voltage level to the low voltage level.

In an exemplary embodiment of the operating method, the drive transistor and the second through fourth are n-type transistors, and the fifth and sixth transistors p-type transistors, the operating method further comprising the steps of: during the combined programming and compensation phase, taking a scan signal SCAN applied to the second through sixth transistors from a low voltage level to a high voltage level; and during the emission phase, taking the SCAN applied to the second through sixth transistors from the high voltage level to the low voltage level.

In an exemplary embodiment of the operating method, the light-emitting device is an organic light-emitting diode (OLED).

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage and carrier mobility compensation. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—first circuit configuration
T1-T8—multiple transistors
C1—capacitor
OLED—light emitting device/organic light-emitting diode
ELVSS—OLED power source
EMI—emission signal
SCAN—scan signal
VDD—power supply
IREF—reference current
N1—node
VDAT—data voltage
20—second circuit configuration
VREF—reference second power supply
30—third circuit configuration
40—fourth circuit configuration
50—fifth circuit configuration
60—sixth circuit configuration
70—seventh circuit configuration
80—eighth circuit configuration

What is claimed is:

1. A pixel circuit for a display device that is operable in a combined programming and compensation phase, and operable in an emission phase, the pixel circuit comprising:

a drive transistor configured to control an amount of current to a light-emitting device during the emission phase depending upon a voltage applied to a gate of the drive transistor;

a second transistor connected to the gate of the drive transistor, wherein the second transistor is in an on state during the combined programming and compensation phase and in an off state during the emission phase, and when the second transistor is in the on state the drive transistor becomes diode-connected such that the gate and a second terminal of the drive transistor are connected through the second transistor;

a third transistor connected to the second terminal of the drive transistor, wherein the third transistor is in an on state during the combined programming and compensation phase to permit a reference current to be applied through the drive transistor, and is in an off state during the emission phase to remove the reference current; and a capacitor having a first plate that is connected to the gate of the drive transistor and a second plate that is connectable to a data voltage (VDAT) during the combined programming and compensation phase;

wherein a threshold voltage and/or a carrier mobility of the drive transistor are at least partially compensated by application of the reference current during the combined programming and compensation phase;

and the pixel circuit further comprises:

a fourth transistor that is connected to the second plate of the capacitor, wherein the fourth transistor is in an on state during the combined programming and compensation phase to apply the VDAT to the second plate of the capacitor, and the fourth transistor is in an off state during the emission phase to isolate the VDAT from the second plate of the capacitor; and a fifth transistor that is connectable to a voltage supply and is connected to the second plate of the capacitor, wherein the fifth transistor is in an off state during the combined programming and compensation phase to isolate the second plate of the capacitor from the voltage supply, and the fifth transistor is in the on state during the emission phase to connect the voltage supply to the second plate of the capacitor.

2. The pixel circuit of claim 1, further comprising a sixth transistor that is in an off state during the combined programming and compensation phase to stop the flow of the reference current to the light-emitting device from the pixel circuit, and is in an on state during the emission phase to permit current that flows through the drive transistor to flow to the light-emitting device.

3. The pixel circuit of claim 2, wherein the drive transistor and the second through fourth transistors are p-type transistors, and the fifth and sixth transistors are n-type transistors.

4. The pixel circuit of claim 2, wherein the drive transistor and the second through fourth transistors are n-type transistors, and the fifth and sixth transistors are p-type transistors.

5. The pixel circuit of claim 2, wherein the sixth transistor is connected between the second terminal of the drive transistor and an output to the light-emitting device.

6. The pixel circuit of claim 2, wherein the sixth transistor is connected between the second terminal of the drive transistor and an input from a voltage supply.

7. The pixel circuit of claim 1, wherein the drive transistor is connectable to a first voltage supply, and the fifth transistor is connectable to a reference second voltage supply; and wherein the fifth transistor is in the off state during the combined programming and compensation phase to isolate the second plate of the capacitor from the reference second voltage supply, and the fifth capacitor is in the on state during the emission phase to connect the reference second voltage supply to the second plate of the capacitor.

8. The pixel circuit of claim 1, wherein the third transistor and the first transistor are configured for the reference current to flow to the light-emitting device during the combined programming and compensation to compensate for voltage variations of the light-emitting device.

9. The pixel circuit of claim 1, wherein the drive transistor and the second through fifth transistors are all p-type transistors.

10. The pixel circuit of claim 1, wherein the drive transistor and the second through fifth transistors are all n-type transistors.

11. The pixel circuit of claim 1, wherein the light-emitting device is an organic light-emitting diode (OLED), a micro light-emitting diode (LED), or a quantum dot LED.

* * * * *